US005542537A

United States Patent [19]

Ford

[11] Patent Number: 5,542,537

[45] Date of Patent: Aug. 6, 1996

[54] PACKAGING OF RECTANGULAR ARTICLES

[75] Inventor: Colin Ford, Atlanta, Ga.

[73] Assignee: Riverwood International Corporation, Atlanta, Ga.

[21] Appl. No.: 501,441

[22] Filed: Jul. 12, 1995

[51] Int. Cl.[6] ..... B65D 25/10

[52] U.S. Cl. ..... 206/431; 206/499; 206/814; 53/445; 53/474

[58] Field of Search ..... 206/427, 431, 206/499, 814; 220/23.83, 23.86; 53/445, 467, 474, 154

[56] References Cited

U.S. PATENT DOCUMENTS

| | | | |
|---|---|---|---|
| 3,887,068 | 6/1975 | Ghione | 220/23.83 X |
| 4,946,037 | 8/1990 | Keith | 220/23.83 X |

*Primary Examiner*—Jacob K. Ackun

[57] ABSTRACT

Arranging a group of articles to be packaged so as to include a space for the insertion of a different article. All the articles except one are arranged in upright position. The one article is positioned on its side, between other articles. This creates a space above the one article into which a different article is inserted prior to packaging the articles in a multipack carton.

11 Claims, 1 Drawing Sheet

PACKAGING OF RECTANGULAR ARTICLES

FIELD OF THE INVENTION

This invention relates to the packaging of rectangular articles, such as aseptic cartons. More particularly, it relates to the packaging of such articles in a multipack arrangement in which one of the articles is different from the others.

BACKGROUND OF THE INVENTION

Aseptic cartons are used for packaging liquids such as fruit juice or milk. They are normally formed of paperboard which has been coated or otherwise treated to make it liquid-tight. Each carton is conventionally in the shape of a rectangular block, which enables a number of cartons to be tightly abutted in a multipack arrangement.

It is sometimes desirable for marketing purposes to include a bonus or gift in the multipack carton. This is usually done by omitting one of the aseptic cartons and replacing it with the gift package. For example, in a multipack carton holding eight aseptic cartons, the aseptic cartons are arranged as if nine cartons were being packaged in three abutting rows, each containing three cartons. The space normally occupied by the center carton in such an arrangement is instead filled by a gift carton containing something other than the liquid in the aseptic carton. This arrangement, however, creates packaging problems. The aseptic cartons are normally moved along a first path to a loading station while the gift items are moved along another path to the same station. This means that the aseptic cartons must be segregated into the final grouping of eight and moved into position while retaining intact the gap reserved for insertion of the gift. The gift must then be moved into position and inserted into the gap, after which the final grouping of aseptic cartons and gift carton is inserted into a multipack carton. These maneuvers require complicated product queuing and gift insertion machinery which, in addition to creating additional maintenance problems, tends to limit the speed with which multipacks can be formed.

It would be desirable to be able to simplify the task of grouping and moving the aseptic cartons as well as the task of inserting the gift and the final grouped cartons into a multipack carton.

BRIEF DESCRIPTION OF THE INVENTION

The invention has to do with the arrangement of the packaged articles within the multipack carton. Articles of substantially the same rectangular shape and size are arranged in a substantially rectangular group so that the bottom of each article except one is in contact with a support surface. The latter article is arranged at right angles to the other articles, with one side in contact with the support surface, so as to form a space between its opposite side and the top of an adjacent first article. Each article in the group abuts an adjacent article. A different article, such as a gift item, is then inserted into the space and the group of articles is packaged in a multipack carton.

This procedure creates a space for receiving the different article but maintains the structural integrity of the group. Thus, when the group is pushed along the support surface toward a loading station, the articles do not move with respect to each other and the space reserved for the different article is maintained at its original size. This reduces difficulties in forming and moving the group of articles and in subsequently introducing the different article into the group.

These and other features and aspects of the invention will be readily ascertained from the following detailed description of the preferred embodiment.

DETAILED DESCRIPTION OF THE PREFERRED EMBODIMENTS

Figure 1:
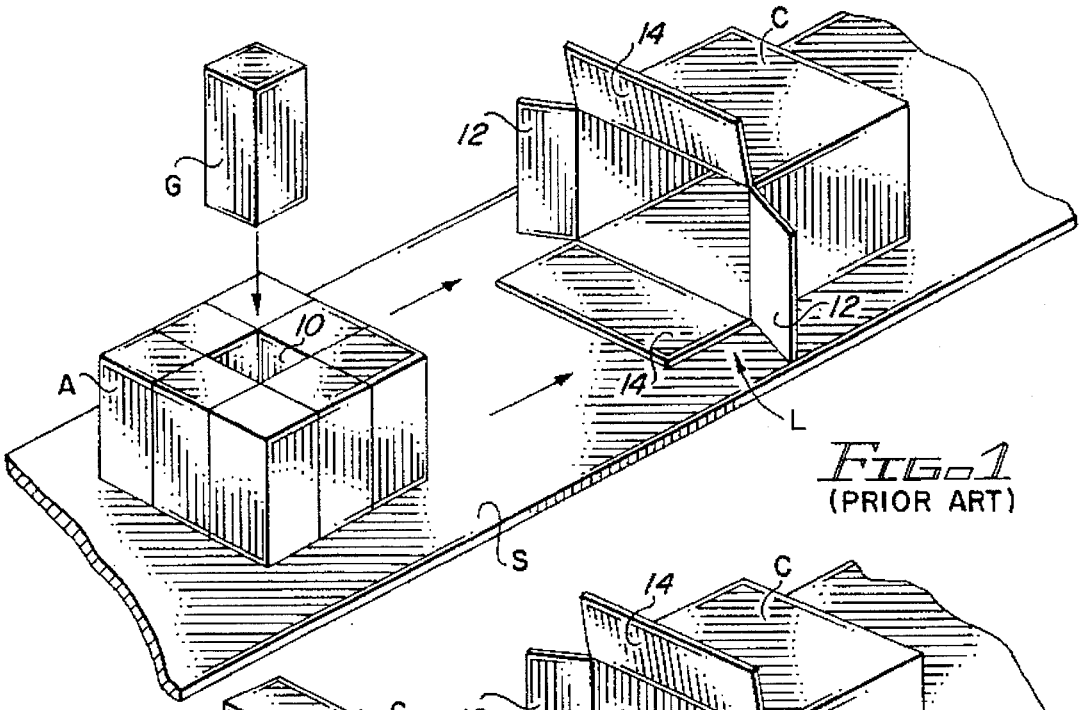
FIG. 1 (PRIOR ART)
FIG. 1 is a pictorial schematic view of a prior art group of aseptic cartons provided with a space for receiving another carton or package prior to being loaded into a multipack carton.

FIG. 1 more clearly illustrates the prior art method of including a different article with other similar articles in a multipack arrangement. Eight aseptic cartons A are grouped on a support surface S in a rectangular configuration made up of four perimeter rows of three each, so that the middle carton in each row is spaced from the opposite middle carton, thereby forming a space 10 in the center of the group of the same size as a carton A. This group of eight cartons is moved to a loading station L where the articles are inserted through the open end of the multipack carton C, after which the glue flaps 12 and the end flaps 14 of the carton are folded into place and glued to complete the formation of the final carton C. Prior to loading the aseptic cartons into the carton C a gift package G is inserted into the space 10. It can be appreciated that arranging the aseptic cartons in the pattern illustrated and then moving them toward the loading station so that the space 10 remains intact can present problems. Use of a pusher bar to move the group of cartons, for example, tends to push the middle carton in the upstream row toward the space 10. Even if such movement is slight, the dimensions of the space are reduced, making it more difficult to insert the gift package.

Figure 2:
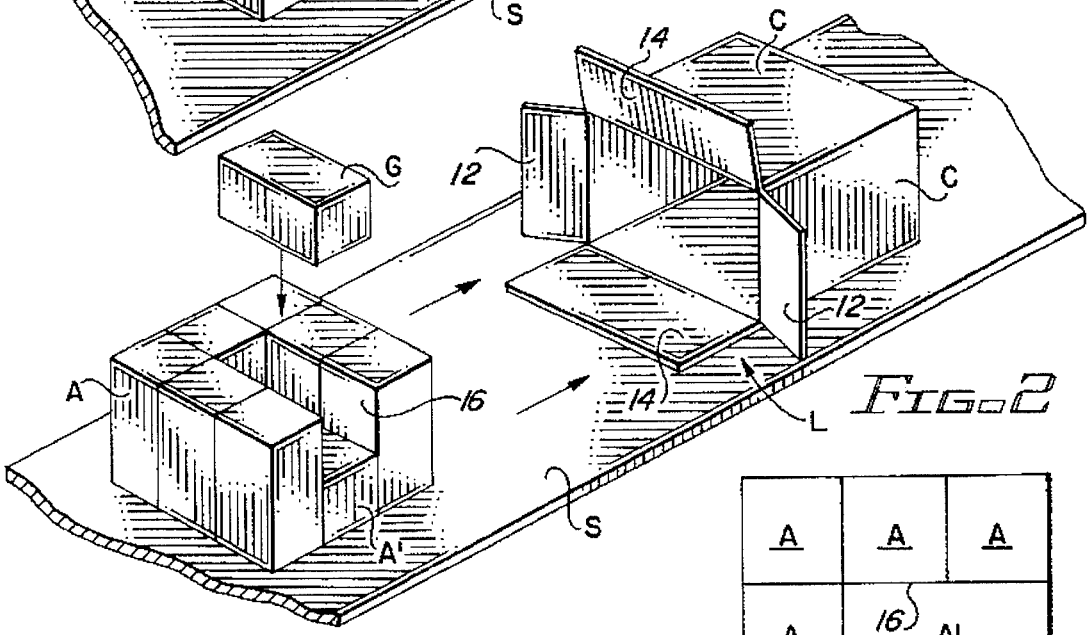
FIG. 2 is a pictorial schematic view of a group of aseptic cartons provided with a space in accordance with the present invention for receiving another carton or package prior to being loaded into a multipack carton.
Figure 3:
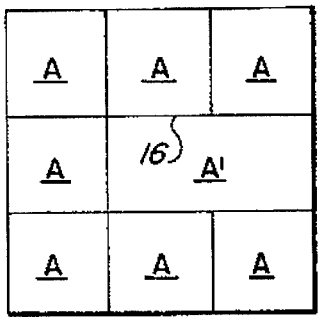
FIG. 3 is a top plan view of the group of cartons shown in FIG. 2.
Figure 4:
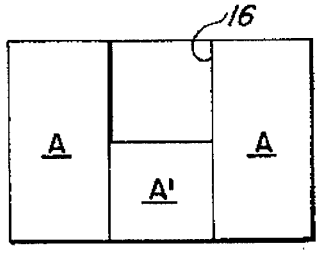
FIG. 4 is a side elevation of the group of cartons shown in FIG. 2.
Figure 5:
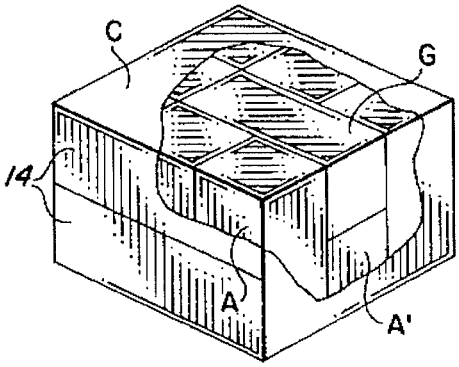
FIG. 5 is a pictorial view of a multipack carton with portions of the carton removed to reveal the packaged contents.

The solution provided by the present invention is illustrated in FIGS. 2, 3 and 4, which shows a group of eight aseptic cartons arranged in a different manner. The cartons A are arranged in three perimeter rows which are similar to the perimeter rows in the prior art grouping. Instead of stanching upright, however, the middle carton A' in the fourth row is supported on its side, so that it extends toward the middle carton in the opposite row. This creates an elongated opening or space 16 into which the gift package can be inserted. Because this arrangement does not create a space extending down to the support surface S, the space 16 cannot be distorted by a pusher bar pushing against the upstream perimeter row of the group. The space 16 is the same shape and size as the space 10 of the prior art, except that it is oriented differently. After insertion of the gift package G, the group of cartons is loaded into the open-ended multipack carton C and the end panels of the carton are then formed as in the prior art practice, resulting in the package illustrated in FIG. 5. For the purpose of illustration, the gift G is shown as being inserted downwardly into the space 16. It will be appreciated, however, that since the space is open to one side of the group, the gift could just as readily be inserted from the side.

Although the carton C is illustrated as being a sleeve-type carton, the invention obviously is not limited by the type of multipack carton in which the aseptic cartons are packaged. Nor is the invention limited by the type of gift package or other item introduced into the space provided in the aseptic carton grouping.

As best shown in FIGS. 3 and 4, the height of the aseptic cartons A illustrated in the drawing is twice their width. With this arrangement the inner end of the carton lying on its side abuts the side of the opposite carton and the outer end of the carton is aligned with the outer sides of the other cartons in the same perimeter row. The resulting solid arrangement of abutting cartons requires simpler machinery for queuing the cartons and inserting the gift package into the space provided, and also eliminates the prior art tendency of the cartons adjacent the space in the grouping to move into the space. The invention may be employed with cartons of other dimensions, but the height of such cartons cannot be greater than the width of the rectangular group of cartons. Otherwise the carton lying on its side would extend beyond one side of the group of cartons and would not be conducive to packaging in the larger multipack carton.

Although the invention has been described in connection with the packaging of aseptic cartons, it may also be used in connection with the packaging of any type of article which is rectangular in transverse cross section where it is desired to introduce a different article into the space created in the group.

The invention need not be limited to the packaging of an item with a group of eight similar articles as illustrated. Other arrangements made up of a different number of articles, but with a space created by one of the articles lying on its side, may also be employed as long as the maximum allowable height of the article referred to above is not exceeded.

Although the invention could be carried out by hand, it is contemplated that elements of a packaging machine would form the articles into a group, push the group of articles downstream, insert a package into the space created in the group and load the group into a carton. The design and operation of such machinery is well within the scope of current packaging technology and is not necessary to an understanding of the invention.

It is contemplated that the invention need not necessarily be limited to all the specific features of the preferred embodiment, but that changes which do not alter the overall basic function and concept of the invention may be made without departing from the spirit and scope of the invention defined in the appended claims.

What is claimed is:

1. A package, comprising:

a plurality of first articles, each having a top, bottom and sides, contained in a rectilinear multipack carton, each first article being of substantially the same shape and size and being rectangular in transverse cross-section;

each of the first articles except one being arranged with its bottom in contact with a common panel of the multipack carton;

said one first article being arranged at right angles to the other first articles, with a side in contact with said common panel;

the first articles abutting adjacent first articles; and a second article different from the first articles supported on said one first article.

2. A package as defined in claim 1, wherein said one first article is located between two other first articles.

3. A package as defined in claim 2, wherein the multipack carton contains eight first articles and the second article.

4. A package as defined in claim 1, wherein the height of the first articles is twice the width of the first articles.

5. A package as defined in claim 1, wherein the first articles are aseptic cartons.

6. A method of packaging a plurality of articles in a multipack carton, comprising:

providing a plurality of first articles, each having a top, bottom and sides, each first article being of substantially the same shape and size and being rectangular in transverse cross-section;

arranging the first articles in a substantially rectangular group so that the bottom of each first article except one is in contact with a support surface;

arranging said one first article at right angles to the other first articles, with a side of said one first article in contact with the support surface, so as to form a space between said one first article and the top of an adjacent first article, the first articles abutting adjacent first articles;

introducing a second article different from the first articles into said space; and packaging the group of articles in a multipack carton.

7. A method as defined in claim 6, wherein said one first article is located between two other first articles.

8. A method as defined in claim 7, wherein the group of articles is comprised of eight first articles and the second article.

9. A method as defined in claim 6, wherein the height of the first articles is not greater than the width of the rectangular group of articles.

10. A method as defined in claim 6, wherein the height of the first articles is twice the width of the first articles.

11. A method as defined in claim 6, wherein the first articles are aseptic cartons.

* * * * *